US008814958B2

(12) United States Patent
Huang

(10) Patent No.: US 8,814,958 B2
(45) Date of Patent: Aug. 26, 2014

(54) LIQUID FUEL WITH ENDOTHERMIC FUEL-CRACKING CATALYST

(75) Inventor: He Huang, Glastonbury, CT (US)

(73) Assignee: United Technologies Corporation, Hartford, CT (US)

( * ) Notice: Subject to any disclaimer, the term of this patent is extended or adjusted under 35 U.S.C. 154(b) by 245 days.

(21) Appl. No.: 13/188,961

(22) Filed: Jul. 22, 2011

(65) Prior Publication Data

US 2013/0020051 A1 Jan. 24, 2013

(51) Int. Cl.
*C10L 1/12* (2006.01)

(52) U.S. Cl.
CPC ..... *C10L 1/1208* (2013.01); *C10L 1/1216* (2013.01); *C10L 2200/0272* (2013.01); *C10L 1/1291* (2013.01); *C10L 2200/0231* (2013.01); *C10L 2230/22* (2013.01)
USPC ..... 44/354; 60/39.12; 60/736

(58) Field of Classification Search
USPC ..... 44/354; 60/39, 39.12, 736
See application file for complete search history.

(56) References Cited

U.S. PATENT DOCUMENTS

| | | | | |
|---|---|---|---|---|
| 3,067,594 | A * | 12/1962 | Bland et al. | 62/4 |
| 3,263,414 | A * | 8/1966 | Herbst | 60/217 |
| 5,151,171 | A | 9/1992 | Spadaccini et al. | |
| 5,337,553 | A * | 8/1994 | Barr | 60/780 |
| 5,997,730 | A | 12/1999 | Drake et al. | |
| 7,334,407 | B2 | 2/2008 | Spadaccini et al. | |
| 7,524,340 | B2 | 4/2009 | May | |
| 2009/0166001 | A1 | 7/2009 | Vanderspurt et al. | |

FOREIGN PATENT DOCUMENTS

| | | |
|---|---|---|
| GB | 745012 | 2/1956 |

* cited by examiner

*Primary Examiner* — Cephia D Toomer
(74) *Attorney, Agent, or Firm* — Carlson, Gaskey & Olds, P.C.

(57) ABSTRACT

A liquid fuel includes a hydrocarbon-based liquid fuel and an additive mixed with the hydrocarbon-based liquid fuel. The additive includes an endothermic fuel-cracking catalyst.

1 Claim, 1 Drawing Sheet

LIQUID FUEL WITH ENDOTHERMIC FUEL-CRACKING CATALYST

BACKGROUND

This disclosure relates to the use of liquid fuel as a heat sink for a heat source.

Liquid fuel is known and used as a propellant in aircraft, rockets, missiles and other vehicles. In addition to the use as a propellant, the fuel is also often used as a cooling fluid to receive and remove heat from a heat source.

DETAILED DESCRIPTION

Figure 1:
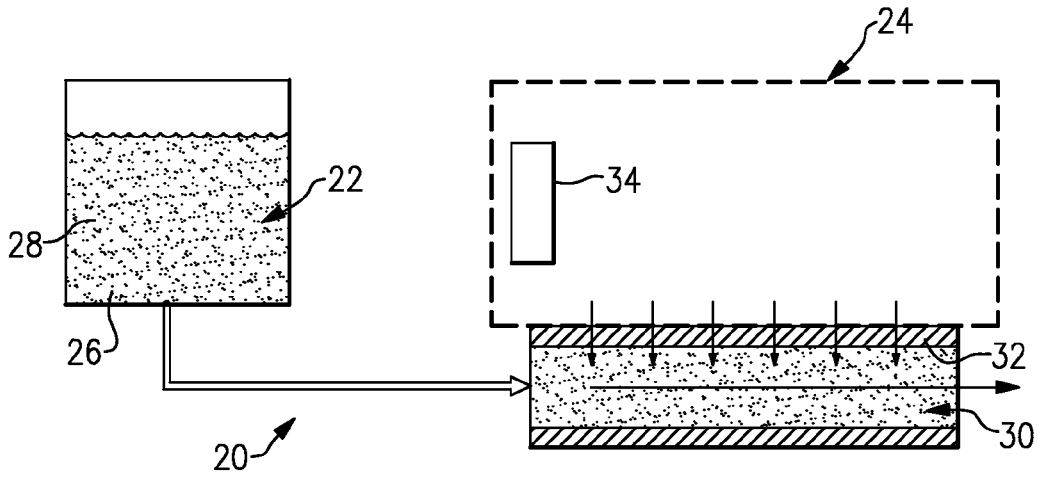
FIG. 1 schematically illustrates an example fuel system that has a liquid fuel that includes a hydrocarbon-based liquid fuel and an endothermic fuel-cracking catalyst.

FIG. 1 schematically illustrates selected portions of an example fuel system 20 that utilizes a liquid fuel 22 as a heat sink to cool a heat source 24. As will be described in further detail, the disclosed liquid fuel 22 includes an endothermic fuel-cracking catalyst that chemically cracks the fuel to increase the endotherm of the liquid fuel 22. The increased endotherm provides the liquid fuel 22 with a greater capacity to receive and remove heat from the heat source 24. For a given heat sink requirement, the disclosed liquid fuel 22 therefore exits the heat source 24 at a relatively lower temperature in comparison to the same liquid fuel without the endothermic fuel-cracking catalyst.

The liquid fuel 22 includes a hydrocarbon-based liquid fuel 26 and an additive 28 (represented as specks in the illustration) mixed with the hydrocarbon-based liquid fuel 26. The additive 28 includes an endothermic fuel-cracking catalyst that is suspended within the hydrocarbon-based liquid fuel 26. In another example, the additive 28 includes other, non-catalytic materials.

In one embodiment, the additive 28 includes particles and the particles include the endothermic fuel-cracking catalyst. For instance, the particles are nano-sized. The nano-sized additive particles 28 may generally be less than 1000 nanometers in average diameter. In a further example, the nano-sized additive particles 28 are approximately 500 nanometers or less in diameter. In further example, the nano-sized additive particles 28 are 100 nanometers or less in average diameter.

In a further example, the additive particles 28 are functionalized to enable suspension of the endothermic fuel-cracking catalyst in the liquid fuel 22. In one example, particles of the endothermic fuel-cracking catalyst are functionalized with functional groups that are compatible with the selected liquid fuel 22. In a further example, particles of the endothermic fuel-cracking catalyst are functionalized with alcohol-containing ligands that are branched or linear. In a further example, the alcohol-containing ligands include decanol and have 10 carbon atoms in a branched or linear structure.

In another embodiment, the additive 28 is molecular (non-particle) and mixes homogeneously with the liquid fuel 22 to form a homogenous solution.

The additive 28 has a relatively high amount of external surface area that is exposed for catalytic activity. The high external surface area renders the endothermic fuel-cracking catalyst especially effective for endothermically chemically cracking the hydrocarbon-based liquid fuel 26 of the liquid fuel 22. Therefore, in comparison to a catalytic coating (e.g., a comparative catalytic coating on the wall 32 of the passage 30 described below), less endothermic fuel-cracking catalyst by weight is needed and the catalyst is more effective in chemically cracking the hydrocarbon-based liquid fuel 26. Moreover, the addition of the endothermic fuel-cracking catalyst to the liquid fuel 22 reduces or eliminates the concern of regenerating the catalyst, as with static catalyst coatings, because the endothermic fuel-cracking catalyst is continually lost in the combustion process and fresh endothermic fuel-cracking catalyst is provided with additional liquid fuel 22. In other systems however, such as a refinery system, the endothermic fuel-cracking catalyst is recovered by filtering, centrifuge or other suitable technique, regenerated and reused. In a refinery system, the endothermic fuel-cracking catalyst suspended in the liquid fuel 22 is optionally selected to produce a desired resultant byproduct from the cracking reactions. Moreover, as described, relatively low amounts of the catalyst are needed, and the catalyst is more effective in obtaining a high yield of the targeted byproduct(s).

In one example, the endothermic fuel-cracking catalyst is present in an amount of 0.001-5 weight percent in the liquid fuel 22. In a further example, the endothermic fuel-cracking catalyst is present in the liquid fuel 22 in an amount of approximately 0.01-1 weight percent, such as 0.1 weight percent.

The hydrocarbon-based liquid fuel 26 is a combustible fuel that is suitable for sustaining combustion in an aircraft, rocket or other combustion-type engine. In one example, the hydrocarbon-based liquid fuel has from 2 to 36 carbon atoms per molecule. In a further example, the hydrocarbon-based liquid fuel is kerosene that includes molecules having mostly between 6 and 16 carbon atoms.

The endothermic fuel-cracking catalyst is a catalyst material that is suitable for endothermically chemically cracking the selected hydrocarbon-based liquid fuel 26. For example, the endothermic fuel-cracking catalyst includes a zeolite material. In another example, the endothermic fuel-cracking catalyst includes at least one of tungsten or molybdenum, which may be in the form of an oxide compound. In another example, the endothermic fuel-cracking catalyst includes a transition metal oxide. The transition metal of the oxide is an element selected from groups 3 through 12 of the Periodic Table. In a further example, the transition metal oxide includes tungsten oxide ($WO_3$), zirconia, or combinations thereof.

In another example, endothermic fuel-cracking catalyst includes a solid superacid catalytic material, such as doped zirconia. In one example, the dopant is tungsten oxide. It is to be understood that the solid superacid catalytic material may alternatively be another material that has an acidity greater than that of 100% pure sulfuric acid.

In further examples, the additive particles 28 consist only of the endothermic fuel-cracking catalyst. In a further embodiment, endothermic fuel-cracking catalyst consists only of one or more of the above example catalytic materials, to the exclusion of other catalytic or non-catalytic materials.

In the disclosed fuel system 20, the liquid fuel 22 is provided to a passage 30 that includes at least one wall 32 that is adjacent the heat source 24 to receive heat there through from the heat source 24. For example, the heat source 24 is a combustion chamber that includes an injector 34 for later injecting the liquid fuel 22 for combustion.

Figure 2:
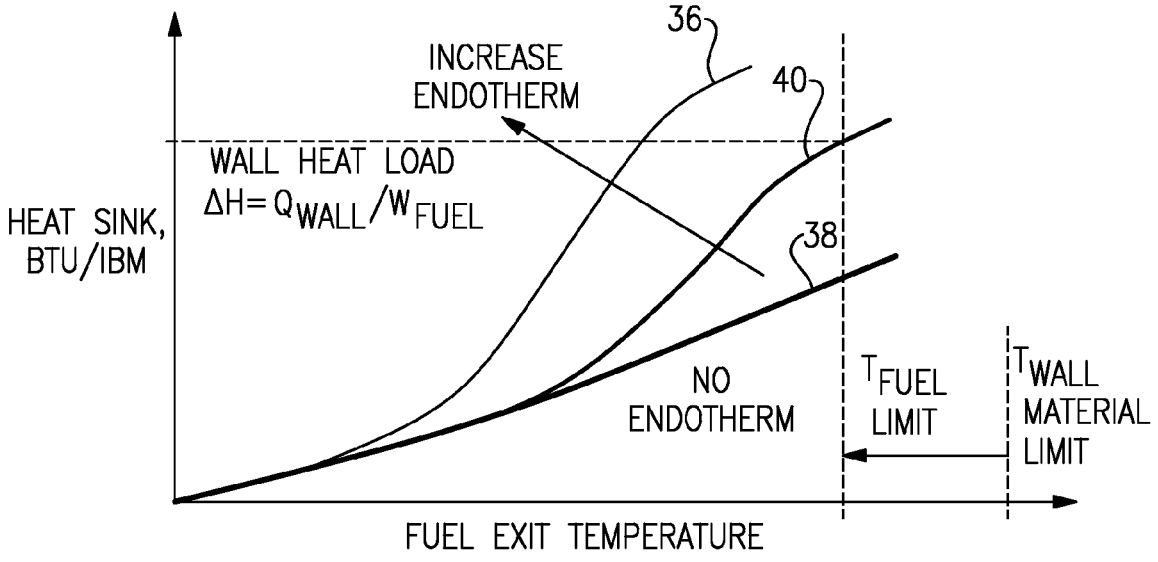
FIG. 2 is a graph showing an increased endotherm of a liquid fuel having an endothermic fuel-cracking catalyst.

As shown in FIG. 2, the endothermic fuel-cracking catalyst increases the endotherm of the liquid fuel 22 (represented at line 36) such that the liquid fuel 22 is more effective in absorbing heat relative to a liquid fuel with no endothermic fuel-cracking catalyst (represented at line 38). Liquid fuel also has a natural endotherm from thermal cracking at elevated temperatures (represented at line 40). As shown, the addition of the additive 28 having the endothermic fuel-cracking catalyst enhances the endotherm of the liquid fuel 22 in comparison to the natural endotherm of the fuel and starts the endotherm of the liquid fuel 22 at much lower temperature in comparison to the natural endotherm of the fuel.

With an increased endotherm, the liquid fuel 22 provides a greater capacity to absorb heat from the heat source 24. Alternatively, for a given heat sink requirement, the liquid fuel 22 exits the passage 30 at a lower temperature in comparison to a liquid fuel that does not include the endothermic fuel-cracking catalyst. The liquid fuel 22 is thereby maintained at a lower temperature in comparison to the liquid fuel that does not include the endothermic fuel-cracking catalyst. The lower temperature of the liquid fuel 22 reduces coke deposits on the walls 32 of the passage 30, which can otherwise block or inhibit flow and require fuel system replacement, special burn-off otherwise block or inhibit flow and require fuel system replacement, special burn-off procedures or the addition of coke-suppression agents that add cost to the fuel. Moreover, the use of the endothermic fuel-cracking catalyst mixed with the hydrocarbon-based liquid fuel 26 provides continuous cracking and coke suppression during flight and therefore allows an aircraft vehicle to complete its mission without servicing to remove coke deposits, for example.

The deposition rate of coke onto the walls 32 is a function of fuel temperature according to Equation I below, where k represents the coke deposition rate, A is a pre-exponential factor, Ea is a coke deposition activation energy, R is the gas constant and T is the fuel temperature. As the fuel temperature increases, the coke deposition rate increases exponentially.

$$k = A \cdot e^{-\frac{Ea}{RT}} \qquad \text{Equation I}$$

Therefore, for a given heat sink requirement, the increased endotherm enables the liquid fuel 22 to operate at a lower temperature and exponentially decrease the coke deposition rate. Additionally, residence time in the passage 30 is typically short (e.g., one second or less). The endothermic fuel-cracking catalyst provides for enhanced mass transfer of fuel molecules to active catalytic sites because of the increased exposed surface area. In comparison, the previously discussed comparative catalytic coating has fewer active catalytic sites and mass transfer of fuel molecules therefore limits catalytic activity. Further, the lower temperature of the liquid fuel 22 increases fuel component life and operation safety and provides thermal management capability to increase aircraft speed and engine thrust-to-weight ratio. In addition, the chemical cracking of the hydrocarbon-based liquid fuel 26 produces hydrogen and light, un-saturated hydrocarbons, such as acetylene, ethylene, propylene, etc., which have very short ignition delay times and very rapid burning rates.

The liquid fuel 22 is manufactured by mixing the additive particles 28 with the hydrocarbon-based liquid fuel 26. For instance, the hydrocarbon-based liquid fuel 26 is a commercially available kerosene type fuel. The mixing of the additive particles 28 into the hydrocarbon-based liquid fuel 26 can occur at the point of storage of the liquid fuel 22 or at another stage in the delivery or handling of the liquid fuel 22.

Although a combination of features is shown in the illustrated examples, not all of them need to be combined to realize the benefits of various embodiments of this disclosure. In other words, a system designed according to an embodiment of this disclosure will not necessarily include all of the features shown in any one of the Figures or all of the portions schematically shown in the Figures. Moreover, selected features of one example embodiment may be combined with selected features of other example embodiments.

The preceding description is exemplary rather than limiting in nature. Variations and modifications to the disclosed examples may become apparent to those skilled in the art that do not necessarily depart from the essence of this disclosure. The scope of legal protection given to this disclosure can only be determined by studying the following claims.

What is claimed is:

1. A method of cooling a heat source, the method comprising:

passing a liquid fuel through a passage adjacent a heat source as a heat sink for the heat source, the liquid fuel including a hydrocarbon-based liquid fuel and an additive mixed with the hydrocarbon-based liquid fuel, the additive including an endothermic fuel-cracking catalyst, wherein the endothermic fuel-cracking catalyst comprises a solid superacid catalytic material; and chemically endothermically cracking the hydrocarbon-based liquid fuel using the endothermic fuel-cracking catalyst.

* * * * *